US007429440B2

(12) United States Patent
Asano et al.

(10) Patent No.: US 7,429,440 B2
(45) Date of Patent: Sep. 30, 2008

(54) ELECTROPHOTOGRAPHIC PHOTORECEPTOR, IMAGE FORMING APPARATUS AND IMAGE FORMING METHOD

(75) Inventors: Masao Asano, Hachioji (JP); Kageyuki Tomoyori, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 396 days.

(21) Appl. No.: 10/925,738

(22) Filed: Aug. 25, 2004

(65) Prior Publication Data

US 2006/0046170 A1 Mar. 2, 2006

(51) Int. Cl.
*G03G 15/04* (2006.01)

(52) U.S. Cl. ..... 430/66; 430/56; 430/69; 430/123.4; 399/159

(58) Field of Classification Search ..... 430/66, 430/56, 59, 123.4; 399/159
See application file for complete search history.

(56) References Cited

U.S. PATENT DOCUMENTS 5,316,536 A * 5/1994 Aiura et al. ..... 492/58
5,840,461 A * 11/1998 Haneda et al. ..... 430/133
6,295,437 B1 * 9/2001 Hodoshima et al. ..... 399/346
6,558,862 B2 * 5/2003 Kojima et al. ..... 430/58.05
2001/0012594 A1 * 8/2001 Ri et al. ..... 430/58.7
2001/0051312 A1 * 12/2001 Itami et al. ..... 430/125
2003/0180646 A1 * 9/2003 Asano et al. ..... 430/126

FOREIGN PATENT DOCUMENTS

| | | |
|---|---|---|
| JP | 63-056658 | 11/1988 |
| JP | 01-315781 | 12/1989 |
| JP | 04-301647 | 10/1992 |
| JP | 04358158 | 12/1992 |
| JP | 5-181291 | 7/1993 |
| JP | 07-248633 | 9/1995 |
| JP | 08-190264 | 7/1996 |
| JP | 08254850 | 10/1996 |

* cited by examiner

*Primary Examiner*—Mark A Chapman
(74) *Attorney, Agent, or Firm*—Lucas & Mercanti, LLP

(57) ABSTRACT

An electrophotographic photoreceptor includes a surface layer having a contact angle of 90 to 130° on a cylindrical conductive substrate having a cylindricity of 5 to 40 μm.

20 Claims, 5 Drawing Sheets

ELECTROPHOTOGRAPHIC PHOTORECEPTOR, IMAGE FORMING APPARATUS AND IMAGE FORMING METHOD

BACKGROUND

1. Technical Field

The present invention relates to an electrophotographic photoreceptor (hereinafter, also referred to as a photoreceptor, simply) used in a copying machine, a printer and the like of electrophotography, an image forming apparatus and an image forming method using the electrophotographic photoreceptor.

2. Description of Related Art

In recent years, image forming in digital form has become mainstream in image forming methods of electrophotography due to development of digital technology. An image forming method in digital form is based on visualization of a pixel image having small pixels such as 400 dpi (dots per inch=2.54 cm). Therefore high image quality technology for re-creating such a small pixel image faithfully is required of the method. In particular, a miniaturized, high resolution and full color copying machine and a printer with improved resolution have been demanded strongly in recent years. A further high image quality technique is required in case of requiring high accuracy, such as high resolution.

Control of the form factor or the particle size distribution of toner and miniaturization of toner particles have been studied for such a demand of enhancing image quality. Development for trying to achieve enhancement of image quality by sharpening form distribution and particle size distribution of toner and miniaturizing toner particles to improve resolution, refined half-toning and the like, is made.

However, enhancing image quality by use of small-particle-size toner is not as effective as initial expectation. Actually, problems are caused by use of small-particle-size toner. That is, one of them is a problem that a toner image formed on a photoreceptor does not have adequate transferability and a problem in cleaning residual toner. The adhesive force of toner to a photoreceptor becomes stronger apparently by miniaturization of toner. As a result the problem that the transferability easily degrades and cleaning becomes difficult, is caused. In particular, a toner image developed with small-particle-size toner having an average particle size of not more than 8 μm has inferior transferability from a photoreceptor to a recording medium and cleanability of residual toner on a photoreceptor, inadequate sharpness, and a strong tendency for poor cleaning caused by toner passing between a photoreceptor and an edge of a cleaning blade, which is so-called "slip through".

To solve such a problem, techniques that a surface layer of an electrophotographic photoreceptor is caused to include a surface energy reduction agent (fine particles and the like) for reducing surface energy in order to diminish an adhesive force of toner to improve transferability and to diminish a frictional force to the blade, and the like, have been studied. For example, JP-Tokukaihei-5-181291A shows a photosensitive layer is caused to include fine particles of alkylsilsesquioxane resin. However, alkylsilsesquioxane is hygroscopic. Because wettability of the surface of a photoreceptor, that is, surface energy increases under a humid circumstance, a problem, such as easy degradation of transferability, is caused.

JP-Tokukaisho-63-56658A discloses an electrophotographic photoreceptor that is caused to include fluororesin powder for reducing surface energy of the surface of a photoreceptor. However, it was found that uneven halftone was easy to occur when transferability and cleanability were improved by use of fluororesin powder. Furthermore it was found that the phenomenon that unevenness of density was caused in halftone image part had a tendency to be caused easily in cases of an electrophotographic image with a cylindrical photoreceptor. Then, in the discussion of the inventors, it is presumed that the phenomenon is caused since surface energies are not reduced uniformly in the surface of the photoreceptor and variations occur in a contact angle of the photoreceptor when surface energies of the surface are reduced by using a surface energy reduction agent to the surface layer of a cylindrical electrophotographic photoreceptor.

SUMMARY

In accordance with the first aspect of the present invention, an electrophotographic photoreceptor comprises a surface layer having a contact angle of 90 to 130° on a cylindrical conductive substrate having a cylindricity of 5 to 40 μm.

In accordance with the second aspect, an image forming apparatus comprises the electrophotographic photoreceptor of the first aspect.

In accordance with the third aspect, an image forming method comprises forming a latent image on the electrophotographic photoreceptor of the first aspect.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF EXEMPLARY EMBODIMENTS

Figure 1:
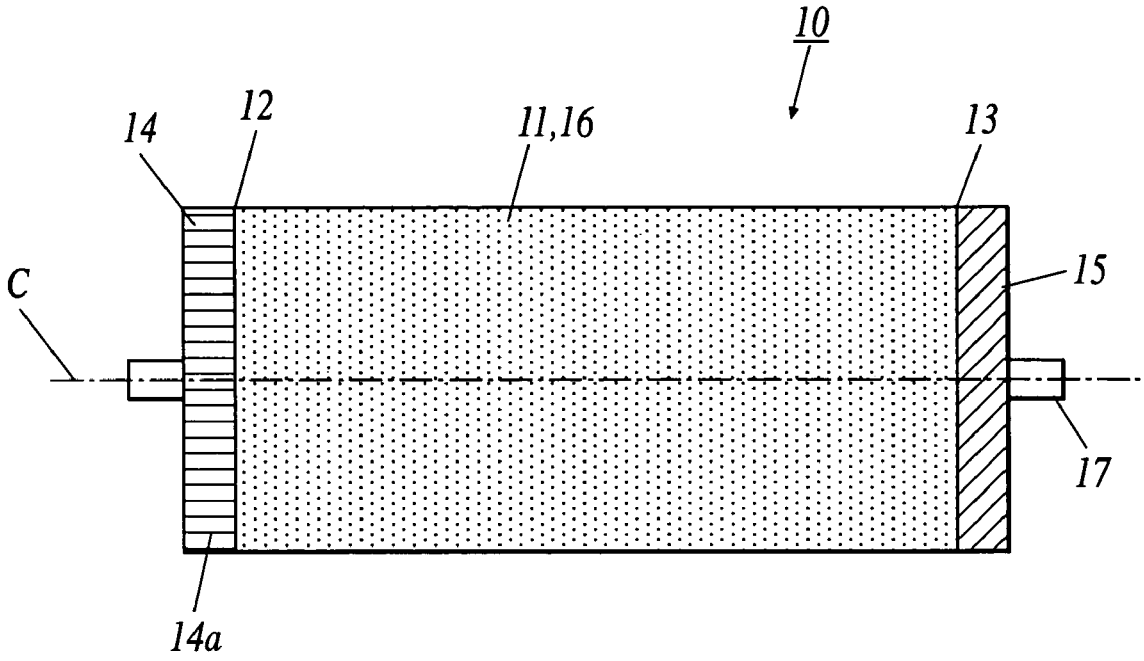
FIG. 1 shows a schematic front view of electrophotographic photoreceptor according to an embodiment of the present invention.

Hereinbelow, an embodiment of an electrophotographic photoreceptor, an image forming apparatus and an image forming method according to the present invention will be described with reference of the drawings. However the present invention is not limited to the illustrated example.

An electrophotographic photoreceptor in the embodiment has a structure in which a surface layer having a contact angle of 90 to 130° is provided on a cylindrical conductive substrate having a cylindricity 5 to 40 μm.

Variation of the contact angle is ±5° in the surface layer of the electrophotographic photoreceptor of the embodiment.

An electrophotographic photoreceptor with the above structure has surface energy of the surface of the photoreceptor reduced uniformly, has good transferability and cleanability of toner, does not generate such an image defect as uneven halftone and can provide an electrophotographic image with good sharpness.

A surface layer simply means a layer existing on the surface in composition of various layers constituting an electrophotographic photoreceptor, and does not show a function. That is, when the electrophotographic photoreceptor has an undercoat layer, an charge generation layer and an charge transport layer laminated on a cylindrical substrate in the order, the charge transport layer is the surface layer. When a protective layer is laminated further, the protective layer is the surface layer.

Cylindricity is based on JIS (B0621-1984). Or when a cylindrical substrate is sandwiched between two coaxial geometrical cylinders, cylindricity is represented by difference between the radii of the two cylinders disposed at the position where an interval between the two cylinders is minimized. The difference between the radii is expressed in terms of μm here.

Cylindricity of cylindrical conductive substrate (hereinafter referred to as a cylindrical substrate or a substrate) is 5 to 40 μm, preferably 7 to 30 μm, and more preferably 7 to 27 μm. In case of more than 40 μm, contact angles easily vary with a position of the surface of the photoreceptor, and consequently, an image defect such as uneven transfer and uneven halftone easily occurs. In case of less than 5 μm, the yield deteriorates and thus there is a disadvantage in costs. The cylindricity of the above-described cylindrical substrate means the cylindricity of an area for forming an image practically, and excludes varying area at both ends not forming an image.

A measurement method of cylindricity is to measure the circularities at a total of 7 points consisting of 2 points at 10 mm from both ends of the cylindrical substrate, the central portion, and 4 points of trisection points between both ends and the central portion. As a measuring instrument, a non-contact universal roll diameter measuring machine (manufactured by Mitsutoyo Corp.) was used.

As for measurement of cylindricity, a sample which is under circumstance of 23° C. and 55% RH for 24 hours is measured under the same conditions. When a flange is attached to a cylindrical substrate, preferably the flange is removed to measure the substrate in a normal situation. However, when the substrate is deformed thereby, the substrate with the flange attached may be measured. In this case, the substrate is measured at a location such that the central axis of rotation in attachment of the substrate to an image forming apparatus and an installation surface to an image forming apparatus are at right angles to each other.

A method for producing a cylindrical substrate having a cylindricity of 5 to 40 μm will be described.

FIG. 1 is a schematic elevational view of an electrophotographic photoreceptor 10 of the present embodiment. The electrophotographic photoreceptor comprises a cylindrical substrate 11, and flanges 14 and 15 provided on both edges 12 and 13 that are both open ends of the cylindrical substrate 11. A photosensitive layer 16 is formed on the surface of the cylindrical substrate 11. A shaft 17 is disposed in the pivot of the electrophotographic photoreceptor 10 in such a way that the shaft 17 coincides with the axis C of the cylindrical substrate, thereby the electrophotographic photoreceptor 10 is made rotatable.

The cylindrical substrate 11 to be used is formed by conductive metal such as Al and aluminum alloys, and is processed to be hollow cylinder-shaped. For example in case of using aluminum alloys, it is made cylindrical by process of drawing and/or cutting.

The flanges 14 and 15 are disk-like to be fitted to the inner surface of the cylindrical substrate 11 to make the cylindrical substrate columnar, and holes 18 are formed in the center thereof. Additionally a toothed gear 14*a* is formed on the periphery of the flange 14, and thereby rotation of the electrophotographic photoreceptor 10 is controllable.

The shaft 17 is a rod-shaped member by use of metal, plastic or the like whose cross section is rectangular like a foursquare or the like, cruciate, circular or the like. Material with less distortion such as cuvature is used. The shaft 17 is fixed through the holes 18 formed in the flanges 14 and 15. As a result, the shaft 17 is a shaft for supporting rotation of the electrophotographic photoreceptor 10.

The photosensitive layer 16 comprises photoconductive material having the photoelectric effect, such as an organic photoconductor (OPC) photosensitive layer.

Figure 2A:
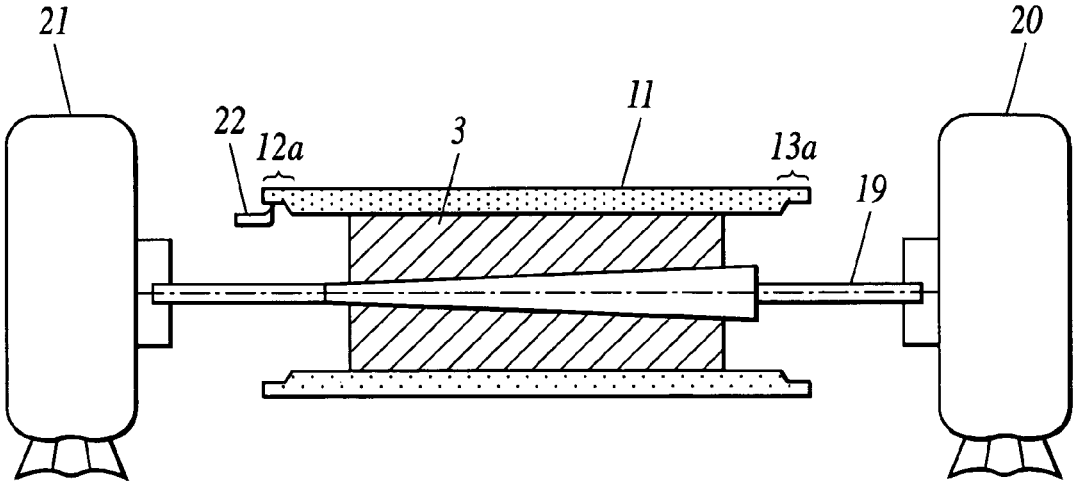
FIGS. 2A and 2B show a production process of cylindrical substrate of the present embodiment in the order of processes of FIG. 2A and FIG. 2B.
Figure 2B:
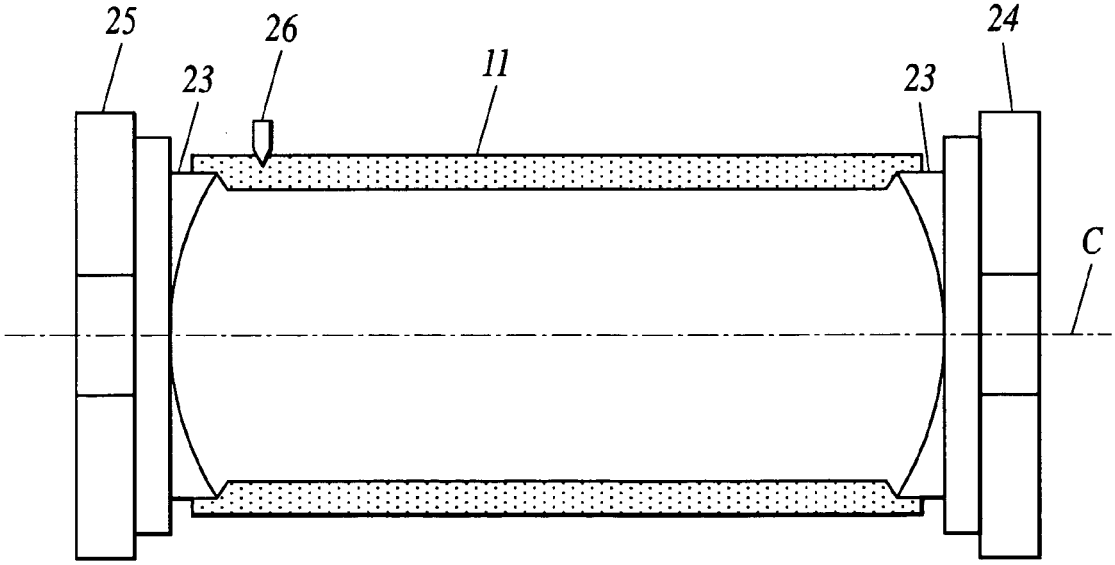

FIGS. 2A and 2B show a production process of cylindrical substrate of the present embodiment in the order of processes of FIG. 2A and FIG. 2B. First, a cylindrical substrate 11 having a hollow cylindrical shape shown in FIG. 2A is prepared. Aluminum alloy formed into wall thickness of 1 mm and an outside diameter of 30 mmϕ by drawing may be used as the cylindrical substrate 11.

FIG. 2A is an illustration showing a supporting member 3 is inserted into the interior of the substrate and processed with a cutting tool as "in low process". The edge portions are treated with "in low process" so as to provide a step thereon. In these portions, thin-walled portions (socket portions) 12*a* and 13*a* having thicknesses decreased and inside diameters enlarged by one thickness of the step are formed although the outside diameter is not changed.

In the "in low process", the interior of the cylindrical substrate is gripped by a supporting member and a pressure variator 4. The cylindrical substrate is rotated around a central shaft 19 penetrating the supporting member by motors 20 and 21. A turning cutter 22 is attached to the interior of the substrate, and the substrate is treated with the "in low process". That is, the surface of the cylindrical substrate is prevented from being scratched by gripping the interior of the cylindrical substrate.

The above-described supporting member is a member that is inserted into the interior of the cylindrical substrate and pressurized to be attached thereto for suppressing vibration and preventing distortion of the substrate in such a process of the cylindrical substrate, as "in low process".

The above-described "in low process" is a process that the interior of a cylindrical substrate is cut so that a machined face, such as a step (for a purpose, such as attaching a flange or the like member thereto), is formed on the interior surface of the substrate. For example, while the cylindrical substrate is rotated, a cutting tool is attached to the cylindrical substrate and fed, and it is machined. For example, in the case of forming a step d mm long in the axial direction of the substrate, when the length of the cylindrical substrate (in the axial direction) is represented by L mm and the length of the supporting member (in the axial direction) is represented by D mm, the length D of the support member is preferably within the following range.

$$1/2 \times L \leqq D < L-2d$$

When D is less than 1/2×L, both edges of the substrate easily swing like a spinning top in the "in low process", and accuracy of the machining is easy to degrade. When D is not less than L-2d, space of the portion to be socket-machined is not enough, and the operation of the machining is difficult.

Next, the socket-machined cylindrical substrate is used so that the surface thereof is cut. FIG. 2B is an illustration in which the socket portions of both edges of the cylindrical substrate with a bore formed by the "in low process" is gripped at opening-and-closing sections of click for grip 23 by non-sliding type open/close chucks (air balloon chuck and kraft greifer manufactured by Fujii Precision Industries, Ltd., and diaphragm chuck manufactured by Dynamic Tools Corp.) 24 and 25, and the surface of the substrate is cut on the inside diameter basis of the socket-machined portion (the central axis of the cylinder bore formed by the "in low process" is regarded as a basic axis).

By adoption of the method for machining a cylindrical substrate as described above, it is possible to manufacture a cylindrical substrate for an electrophotographic photoreceptor having an outside cylindricity of 5 to 40 μm. Reference numeral 26 is a cutter for cutting.

As the supporting member, a rigid member having strong hardness is preferable in order to suppress vibration in "in low process" and retain its shape. A metal, such as stainless and brass, ceramics and the like are suitable for the rigid member. Additionally a member provided with a pressure variator or the like is suitable as the rigid member. Hereinbelow, a method for inserting the rigid member into the inside of the cylindrical substrate to press the substrate will be described.

Figure 3A:
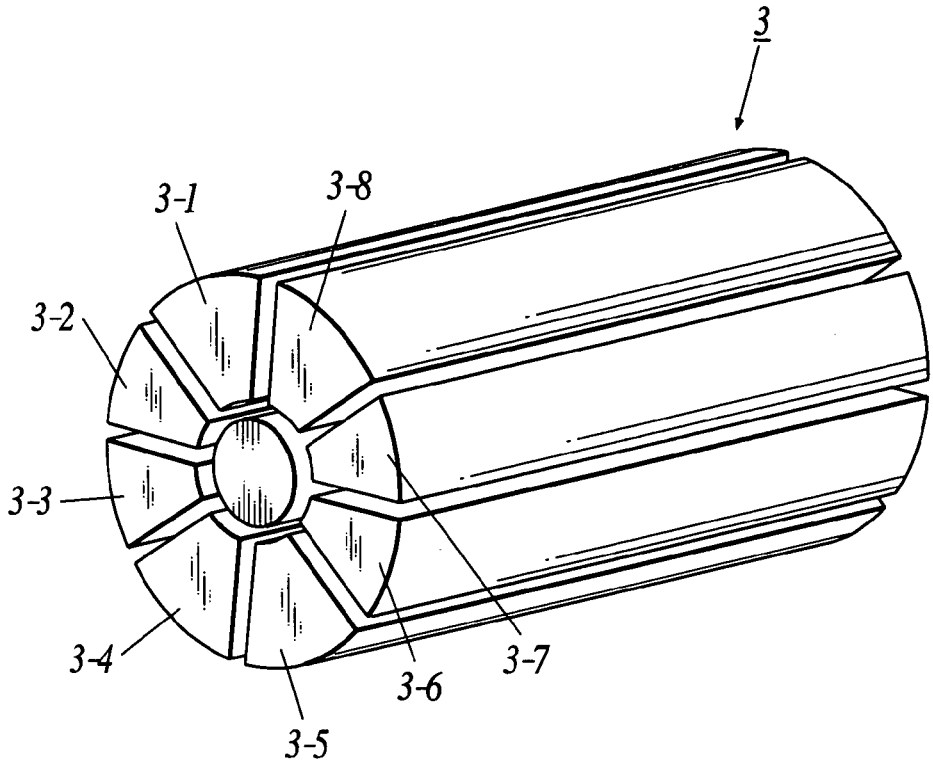
FIG. 3A is a perspective view of a supporting member.
Figure 3B:
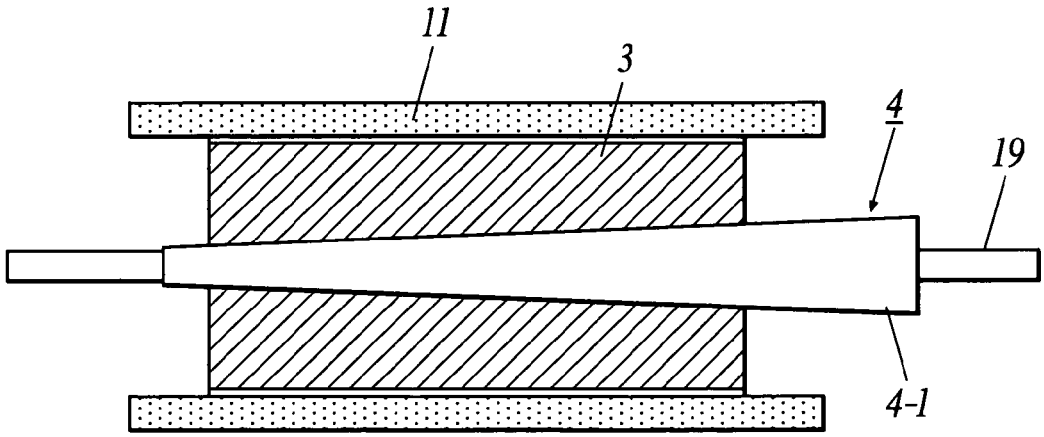
FIG. 3B is a sectional view showing a pressure variator of the supporting member.

FIG. 3A is a perspective view of a supporting member 3. FIG. 3B is a sectional view showing a pressure variator 4 of the supporting member. Each of 3-1 to 3-8 represents a part of the supporting member whose cross-section is a sector. The parts are combined each other by not shown loose joints, for example, springs to constitute the whole of the supporting member. The exterior surface of the supporting member forms a cylindrical shape so as to come into contact with the interior surface of the cylindrical substrate. As shown in FIG. 3B, the central portion of the supporting member forms as a pressure variator 4 a ring through which a central rod 4-1 with a tabor can be taken in and out. By inserting the central rod 4-1 as shown in FIG. 3B, the supporting member is expanded outward to support with press the cylindrical substrate. Pressure of press is adjusted by the depth of insert of the central rod 4-1.

Instead of the rigid member, an elastic member, such as rigid urethane and rubber, may be used as the supporting member.

The central rod 4-1 has a central shaft 19 penetrating the supporting member. The cylindrical substrate is rotated around the central shaft for "in low process".

Figure 4:
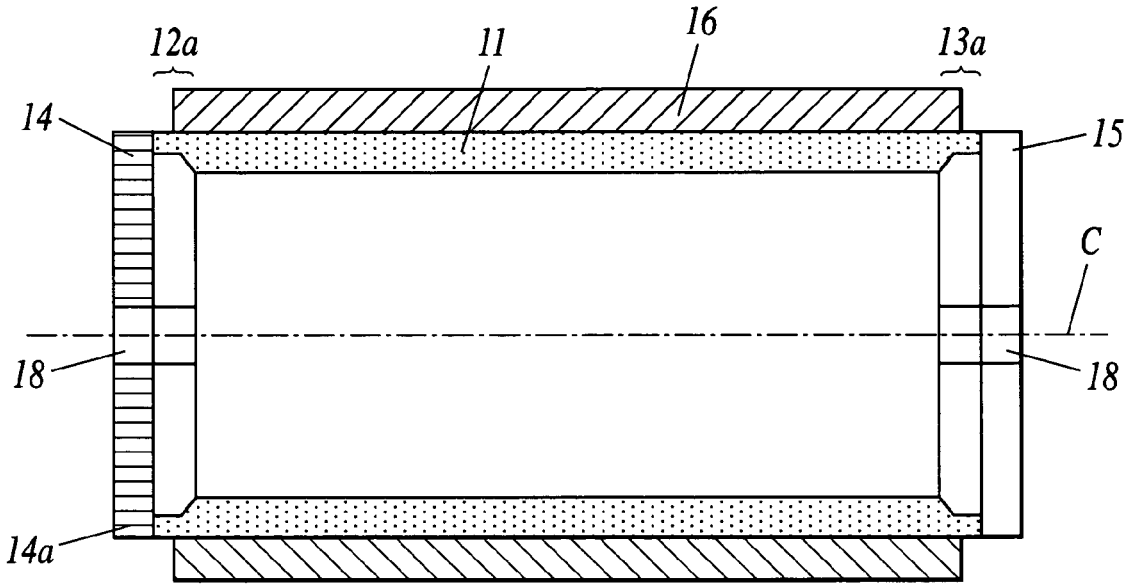
FIG. 4 is an illustration showing a photosensitive layer is formed by coating on the exterior surface of the cylindrical conductive substrate.

Next, a photosensitive layer 16 is formed by coating on the exterior surface of the cylindrical substrate 11 as shown in FIG. 4 after the substrate is cleaned.

The flanges 14 and 15 are attached to the cylindrical substrate having the photosensitive layer formed. Each of the flanges 14 and 15 is disk-like and has an outside diameter approximately equal to the outside diameter of the cylindrical substrate 11. Each of the flanges 14 and 15 comprises an outside part attached to the cylindrical substrate to be covers, and an inside part with an outside diameter smaller than the outside part. A hole 18 is formed at the center thereof. In the inside portions with a smaller outside diameter, their outside diameters are made equal to or a little larger than the inside diameter of the thin-walled portions 12*a* and 13*a* formed by the above-described "in low process". The inside portions with the small outside diameter of the flange 14 and 15 are fitted with the thin-walled portions 12*a* and 13*a* of the cylindrical substrate, respectively. Thereby the flanges 14 and 15 are fixed to the ends of the cylindrical substrate 11 as the flanges cover. In the condition of the flanges 14 and 15 attached, the cylindricity of the cylindrical substrate 11 with center at an axis C is preferably from 5 to 40 μm. A toothed gear 14*a* is formed on the periphery of one flange 14. Holes 18 are provided in the center of the flanges for fixing the shaft.

As described above, a photoreceptor of the present embodiment comprises a surface layer with a contact angle of 90 to 130° on a cylindrical conductive substrate having a cylindricity of 5 to 40 μm.

If the contact angle of the photoreceptor is made large, that is, surface energy of the photoreceptor is reduced, adhesive forces of toner, paper powder and the like become weak. Then transferability of a toner image on the photoreceptor and cleanability of residual toner and paper powder are improved and an electrophotographic image with good sharpness is easily available. Whereas, variation of the contact angle depending on a position of the surface of the photoreceptor becomes large, thereby variation of transferability becomes large and unevenness of image is easily caused in a halftone image. Therefore the variation of the contact angle of the photoreceptor depending on a position is reduced by providing a surface layer with a contact angle of 90 to 130° on a cylindrical conductive substrate having a cylindricity of 5 to 40 μm, and generation of uneven halftone is diminished by making the variation ±5°.

The variation of the contact angle of the photoreceptor is ±5° from the average in the present embodiment as described above, but, preferably ±4° and more preferably ±3°. When the variation is more than ±5° from the average, uneven halftone is easily generated and also toner scatterings in text, hollow defects and the like are easily generated.

For making the contact angle of the photoreceptor 90 to 130°, it is preferable to cause the surface layer of the photoreceptor to contain a surface energy reduction agent to increase the contact angle. However, as for a surface energy reduction agent that can increase the contact angle over 130°, no suitable material is found. If there is such a material, adding the material to an electrophotographic photoreceptor easily accompanies degradation of an electrophotographic image.

Here a surface energy reduction agent is a material that is added to the surface layer of an electrophotographic photoreceptor to reduce surface energy of the electrophotographic photoreceptor. In concrete terms, it is a material of which addition to the surface increases a contact angle of an electrophotographic photoreceptor (a contact angle to pure water) by 1° or more.

<<Measurement of a Contact Angle and Variation of a Contact Angle>>

A contact angle is a contact angle of the surface of the photoreceptor for water. A contact angle of the photoreceptor is measured under a circumstance of 30° C. and 80% RH by using a contact angle meter (CA-DT•A type manufactured by Kyowa Interface science Co., Ltd.). Pure water and a photoreceptor to be used are under an environment of 30° C. and 80% RH for 24 hours and then measured. As for the measurement apparatus, another apparatus may be used as long as its principle and conditions of measurement are the same.

Variation of the contact angle is measured under an environment of 30° C. and 80% RH. Measured points are a total of 14 points, consisting of 4 points at a 90° interval in the circumferential direction at each of 3 points of the central portion and positions of 5 cm from the both ends of a cylindrical photoreceptor. The contact angle is their average. A value of variation is the difference in a plus or minus direction furthest away from the average.

A surface energy reduction agent is not limited to material such as a fatty acid metal salt and a fluororesin, if it is material increasing contact angle of an electrophotographic photoreceptor (contact angle for pure water) by 1° or more.

The surface energy reduction agent is material that is contained in the layer of a photoreceptor and accordingly increase the contact angle. As the most surface energy reduction agent, a fluororesin particle, such as polyvinylidene fluoride and polytetrafluoroethylene, is preferable. In particular, resin particles of an average particle size of 0.01 to 2.0 μm with good releasability containing fluorine atoms is preferable.

A fatty acid metal salt is preferable as other material. The fatty acid metal salt is preferably a metal salt of saturated or unsaturated fatty acid having a carbon number of not less than 10. As an example, aluminum stearate, indium stearate, gallium stearate, zinc stearate, lithium stearate, magnesium stearate, sodium stearate, aluminum palmitate, aluminum oleate and the like are taken, and more preferably metallic stearate is taken.

Besides the surface energy reduction agent, inorganic fine particles of a number average particle size of 5 to 1000 nm are preferably added to the surface layer of the photoreceptor. The variation of the contact angle of the photoreceptor is easily decreased much further by inorganic fine particles like this combined with the surface energy reduction agent. Additionally, hydrophobized inorganic fine particles (for example, described in JP-Tokukaihei-8-248663A and the like) are dispersed and contained in the surface of the photoreceptor to adjust the surface roughness, preferably. As a method for hydrophobization of inorganic fine particles, it is possible to use a method of treatment with a hydrophobizing agent, such as titanium coupling agent, silane coupling agent, a macromolecular fatty acid and its metal salt.

Inorganic fine particles include, for example, fine particles of silica, titanium oxide, alumina, barium titanate, calcium titanate, strontium titanate, zinc oxide, magnesium oxide, zirconium oxide, barium sulfate, barium carbonate, calcium carbonate, silicon carbide, silicon nitride, chrome oxide, red oxide and the like.

As described above, inorganic fine particles are preferably treated by hydrophobization. In the hydrophobization, the inorganic fine particles and hydrophobizing agent may be reacted under high temperature. The hydrophobizing agent, which is not limited particularly, includes, for example, a silane coupling agent, such as hexamethyldisilazane, dimethyldichlorosilane, decylsilane, dialkyldihalosilane, trialkylhalosilane and alkyltrihalosilane, dimethyl silicon oil and the like. Although the amount of the hydrophobizing agent varies with the kind and the like of the above-described fine particles and the like, and can not be necessarily defined, increase of the amount causes degree of hydrophobization to be high generally. Additionally it is also effective to remove hygroscopic material, for example, by reprecipitation, heat treatment or the like.

The above-described number average particle size is obtained from measured values as an average feret diameter by image analysis of random 100 particles that are observed as the first particles at a magnification of 2000 times with a transmission electron microscope.

Next a photoreceptor will be described.

A photoreceptor is an electrophotographic photoreceptor to be used for forming an electrophotographic image. Above all, in the case of use of an organic electrophotographic photoreceptor (organic photoreceptor), the effect of good cleanability of toner and forming a sharp electrographic image without unevenness of image appears significantly. The organic photoreceptor is an electrophotographic photoreceptor comprising an organic compound with at least one of charge generation function and charge transport function, which are essential to the composition of an electrophotographic photoreceptor. The organic photoreceptor includes all of known photoreceptors, such as photoreceptors comprising a known organic charge generation compound or a known organic charge transport compound and photoreceptors having a charge generation function and a charge transport function comprising polymer complex.

Hereinbelow the composition of an organic photoreceptor to be used in the present embodiment will be described.

<<Conductive Substrate>>

Here a cylindrical conductive substrate means a cylindrical support necessary to form images endlessly by rotation and its cylindricity is 5 to 40 μm. Additionally it is preferably a conductive support having a straightness not more than 0.1 mm and a deflection not more than 0.1 mm. If its straightness or deflection is over the ranges, good image forming becomes difficult.

The outside diameter of the cylindrical substrate is preferably 10 to 60 mm. That is, a cylindrical substrate of such a relative small diameter is easy to generate uneven halftone. Therefore the effect of good cleanability of toner and forming a sharp electrographic image without unevenness of image appears significantly. Considering ease of design of the after-described image forming apparatus, the outside diameter of the substrate is more preferably 25 to 60 mm.

A metallic drum of aluminum, nickel or the like, a plastic drum on which aluminum, tin oxide, indium oxide or the like is deposited, and a paper or plastic drum coated with conductive material may be used as material of a photoconductive substrate. As a photoconductive substrate, its resistivity is preferably not more than $10^3$ Ωcm at ordinary temperature.

<<Undercoat Layer>>

An undercoat layer (UCL) to be used for the above-described photoreceptor is provided in order to improve adhesion of a cylindrical substrate and a photosensitive layer or prevent charge injection from the cylindrical substrate. A material of the undercoat layer includes polyamide resin, vinyl chloride resin, vinyl acetate resin and copolymer resin containing two or more of repeating units of these resins. Among the resins, polyamide resin is preferable as a resin capable of reducing increase of residual potential accompanied by repeated use. The thickness of the undercoat layer using the resins is preferably 0.01 to 2.0 μm.

The undercoat layer to be used most preferably includes an undercoat layer using a hardening metallic resin made by thermosetting an organometallic compound such as a silane coupling agent and a titanium coupling agent. The thickness of the undercoat layer using the hardening metallic resin is preferably 0.01 to 2.0 μm.

Another preferable undercoating layer includes what contains titanium oxide and binder resin and is coated with a solution of the binder resin in which titanium oxide is dispersed. The thickness of the undercoat layer using titanium oxide is preferably 0.1 to 15 μm.

<<Photosensitive Layer>>

The composition of a photosensitive layer of the above-described photoreceptor may be a composition of a photosensitive layer of single-layer structure having charge generation function and charge transport function in one layer on the above-described undercoat layer. More preferably, the composition is a composition in which the functions of the photosensitive layer is separated into a charge generation layer (CGL) and a charge transport layer (CTL). Due to adoption of this composition, it is possible to control increase of residual potential accompanied by repeated use to reduce and it is easy to control other electrographic characteristics to suit a purpose. In a photoreceptor for negative charging, the composition that a charge generation layer (CGL) is on an undercoat layer and a charge transport layer (CTL) is thereon is preferably adopted. In a photoreceptor for positive charging, the above-described layer composition is reverse sequence of that of a photoreceptor for negative charging. The most preferable photosensitive layer composition is the composition of a photoreceptor for negative charging having the above-described separation-function structure.

Hereinbelow a photosensitive layer composition of a separated-function photoreceptor for negative charging will be described.

<<Charge Generation Layer>>

A charge generation layer contains a charge generation material (CGM). The charge generation layer may contain binder resin and other additives as other material.

A known charge generation material (CGM) may be used as the charge generation material (CGM). For example, phthalocyanine pigment, azo pigment, perylene pigment, azulenium pigment and the like may be used. Among them, the CGM capable of the most reduction of increase of residual potential accompanied by repeated use is what has spacial and potential configurations capable of forming a stable coagulation structure between a plurality of molecules. In concrete terms, CGMs of phthalocyanine pigment and perilene pigment having a specific crystal structure is taken. For example, CGMs of titanylphthalocyanine having the maximum peak at Bragg angle 2θ of 27.2° for Cu-Kα radiation, benzimidazole perylene having the maximum peak at the same 2θ of 12.4° and the like have least degradation accompanied by repeated use and can reduce increase of residual potential.

In case of use of binder as a dispersion medium of a CGM in a charge generation layer, known resins may be used as the binder. The most preferable resins include formal resin, butyral resin, silicone resin, silicone modified butyral resin, phenoxy resin and the like. A proportion of charge generation material and binder resin is preferably from 20 to 600 wt parts for 100 wt parts of the binder resin. By using these resin, increase of residual potential accompanied by repeated use can be reduced the most. The thickness of the charge generation layer is preferably 0.01 μm to 2 μm.

<<Charge Transport Layer>>

A charge transport layer contains a charge transport material (CTM) and a binder resin for dispersing CTM to form a coat. If necessary, the charge transport layer may contain additives, such as an anti-oxidizing agent, as other material.

A known charge transport material (CTM) may be used as the charge transport material. For example, triphenylamine derivatives, hydrazone compounds, styryl compounds, benzidine compounds, butadiene compounds and the like may be used. These charge transport materials are generally dissolved in a suitable binder resin to form a layer. Among them, the CTM capable of the most reduction of increase of residual potential accompanied by repeated use has high mobility and a characteristic that difference of ionization potential between the CTM and a combined CGM is not more than 0.5 (eV), and preferably not more than 0.25 (eV).

The ionization potential of a CGM and a CTM is measured by a surface analysis instrument AC-1 (manufactured by RIKEN KEIKI Co., Ltd.).

Resin to be used in a charge transport layer (CTL) includes, for example, polystyrene, acryl resin, methacryl resin, vinyl chloride resin, vinyl acetate resin, polyvinylbutyral resin, epoxy resin, polyurethane resin, phenol resin, polyester resin, alkyd resin, polycarbonate resin, silicone resin, melamine resin and copolymer resin containing two or more of repeating units of these resins, and in addition to these insulation resins, a semiconductive organic polymer, such as poly-N-vinylcarbazole. The most preferable binder of these CTLs is polycarbonate resin. The thickness of a charge transport layer is preferably 10 to 40 μm.

<<Protective Layer>>

Various resin layers may be provided as a protective layer of a photoreceptor. In particular, an organic photoreceptor with good mechanical strength can be obtained by providing a cross-linkage type of resin layer.

As for toner to be used in an image forming method or an image forming apparatus of the present embodiment, there are cases of toner containing magnetic material to be used as one component magnetic toner, toner mixed with so-called carrier to be used as a two component developer, nonmagnetic toner to be used alone, and the like. Each of them can be used suitably, and preferably a two component developer of toner mixed with carrier is used. The volume average particle size of toner to be used in an image forming method and an image forming apparatus of the present embodiment is preferably 3.5 to 8.5 μm. By applying toner of such a small particle size to an image forming method and an image forming apparatus of the present embodiment, a high-quality electrophotographic image with good sharpness can be obtained. The above-described volume average particle size of toner particles is measured by a Coulter counter TA- or a Coulter Multisizer (manufactured by Coulter Inc.).

A surface layer represents, for example, a surface in contact with toner in development. A layer capable of consisting the surface layer may be any one of the photosensitive layer, the CLT, the CGT, the protective layer and the like.

Next, an image forming apparatus will be described.

Figure 5:
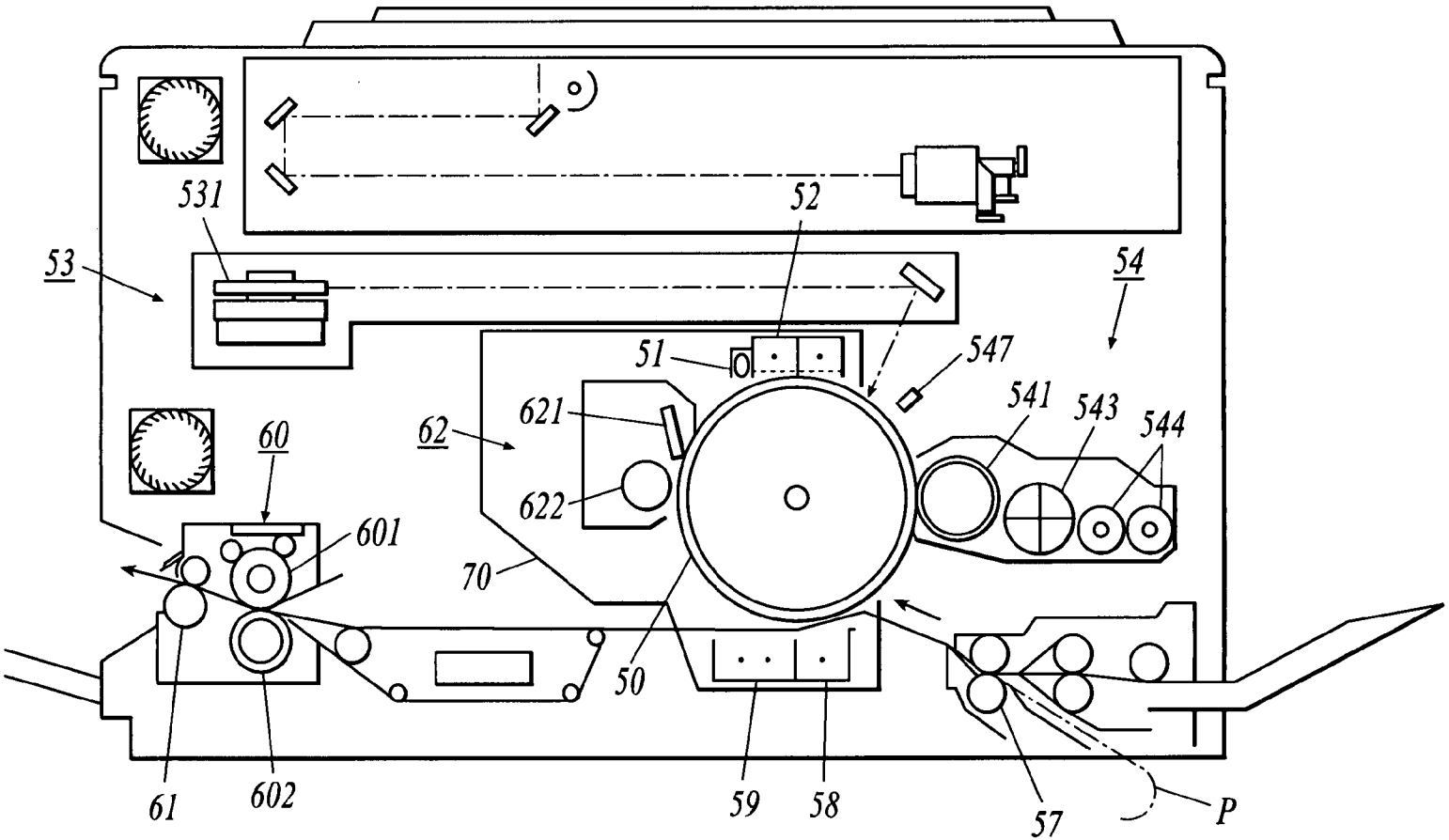
FIG. 5 is a sectional view of an image forming apparatus of the present embodiment.

FIG. 5 is a sectional view of an example of an image forming apparatus in the present embodiment.

A photosensitive drum (photoreceptor) 50, which is an image support, is a photoreceptor comprising a drum coated with an organic photosensitive layer and a resin layer applied onto the layer, and is grounded and rotated clockwise. A scorotron charger (member for charging) 52 uniformly charges the peripheral surface of the photosensitive drum 50 by corona discharge. Before charging by the charger 52, charge of the peripheral surface of the photoreceptor may be eliminated by exposure by a section for exposure before charging 51 using a LED or the like in order to clear history of the photoreceptor in the previous image forming.

After charging the photoreceptor uniformly, image exposure based on image signal is performed by an image exposure device 53 as a member for image exposure. The image exposing device 53 in this figure has a not shown laser diode as a light source of exposure. Light passing through a rotating polygon mirror 531, f lens and the like, and having its optical path turned by a reflecting mirror scans the surface of the photosensitive drum to form a latent image.

Reversal development process is an image forming method that the surface of the photoreceptor is charged by the charger 52 uniformly and an area processed by image exposure, that is, exposed portion potential (exposed area) of the photoreceptor is developed by a developing step (member). Whereas, unexposed portion potential is not developed by a developing bias voltage applied to a developing sleeve 541.

The latent image is developed by a developing device 54 as a developing member. The developing device including a developer comprising toner and carrier is provided at the periphery of the photosensitive drum 50. Development is performed by the developing sleeve 541 including a magnet, bearing a developer and rotating. The inside of the developing device 54 comprises the developer agitating/transferring members 543, 544, a transferred amount regulating member which is not shown, and the like. The developer is agitated and transferred to be supplied for the developing sleeve. The amount supplied is controlled by the transferred amount regulating member. While the transferred amount of the developer is different depending on an applied linear velocity of an organic electrophotographic photoreceptor and a relative density of the developer, it is generally within the range of 20 to 200 mg/cm$^2$.

A developer comprises, for example: carrier in which a core of the above-described ferrite is coated with insulation resin; and toner in which silica, titanium oxide and the like are externally added to coloring particles comprising the above-described styrene acrylic resin as a main material, a coloring agent such as carbon black, a charge control agent and low molecular weight polyolefin. The developer has its thickness regulated by the transferred amount regulating member and is transferred to a development area so that development is performed. At this time, a DC bias voltage and, if necessary, an AC bias voltage are applied between the photosensitive drum 50 and the developing sleeve 541 so that development is performed. The developer is developed in or out of contact with photoreceptor. A potential sensor 547 is provided at a position over the development position as shown in FIG. 5 to measure the potential of the photosensitive drum.

After image forming, recording paper P is fed to a transfer area by a paper feed roller 57 when the timing of transfer becomes right.

In the transfer area, a transfer electrode (transfer member: transfer unit) 58 of the peripheral surface of the photosensitive drum 50 is activated with synchronization to the timing of the transfer to sandwich the fed recording paper (recording medium) P adhesively to be transferred onto.

Next, charge of the recording paper P is eliminated by a detaching electrode (detaching unit) 59 that has been activated almost as soon as the transfer electrode. The recording paper P is detached from the peripheral surface of the photosensitive drum 50 to be transferred to a fixing device 60. Toner on the recording paper P is adhered by heating and compression of a heating roller 601 and a pressure roller 602 and then the recording paper P is ejected through an eject roller 61 to the outside of the apparatus. After the recording paper passes, the transfer electrode 58 and the detaching electrode 59 leave and keep space from the peripheral surface of the photosensitive drum 50 to prepare for forming a next toner image. In FIG. 5, a transfer belt electrode of scorotron is used as the transfer electrode. Although setting conditions of the transfer electrode can not be specified generally, for example, it is possible to make a transfer current +100 to +400 μA and a transfer voltage +500 to +2000V as setting values.

As for the photosensitive drum 50 after detachment of the recording paper P, residual toner thereon is removed and the drum is cleaned by sliding with pressure of a blade 621 of a cleaning unit 62 (cleaning member). Then the drum is charged again by the section for exposure before charging 51 and the charger 52 to enter the process for next image forming.

A process cartridge 70 is an unified combination of the photoreceptor, the charger, the transfer unit, the detaching unit and the cleaning unit to be detachable.

The above-described organic electrophotographic photoreceptor is suited for an electrophotographic duplicator, a laser printer, a LED printer, a liquid crystal shutter printer and the like, and additionally, can be suited widely for apparatuses with application of electrophotography for display, record, light printing, plate making, facsimile and the like.

The present invention is not limited to the above-described embodiment and various modifications and changes of design is allowed without departing from the scope of the present invention.

EXAMPLES

Hereinbelow examples of the present invention will be described, but an embodiment of the present invention is not limited to the following example.

1. Production of Cylindrical Substrate

<<Processing Method for Substrate>> a. Processing of a Cylindrical Substrate A-1

The pressure variator 4 in FIG. 3B was used in a cylindrical substrate (length L=344 mm, diameter ϕ (outside diameter=60 mm)) formed by drawing and made of 1.25 mm-thick aluminum alloy so that a stainless supporting member with length D=300 mm (0.84×L) was supported with pressure on the inside of the cylindrical substrate. The cylindrical substrate was formed by "in low process" into a diameter ϕ=98.40 mm based on the outside diameter (based on the central axis of a cylinder of the exterior surface of the cylindrical substrate as a reference axis) and a length d=8 mm (for the "in low process", using a simultaneous turning of both ends BS manufactured by Eguro Ltd.)

Then both ends of the cylindrical substrate was gripped by use of the non-sliding type open/close chucks and the surface of the substrate was cut based on the inside diameter of the socket-machined portion (for the cutting, using a SPA-5 manufactured by Shoun kousakusho). The cylindricity of the cylindrical substrate A-1 after the processing was 8 μm.

b. Processing of a Cylindrical Substrate A-2

A cylindrical substrate A-2 was socket-machined and cut in the same way as the cylindrical substrate A-1 except for D=241 mm (0.70×L). The cylindricity of the cylindrical substrate A-2 after the processing was 25 μm.

c. Processing of a Cylindrical Substrate A-3

A cylindrical substrate A-3 was socket-machined and cut in the same way as the cylindrical substrate A-1 except for D=189 mm (0.55×L). The cylindricity of the cylindrical substrate A-3 after the processing was 37 μm.

d. Processing of a Cylindrical Substrate A-4

A cylindrical substrate A-4 was socket-machined and cut in the same way as the cylindrical substrate A-1 except for D=154 mm (0.45×L). The cylindricity of the cylindrical substrate A-4 after the processing was 46 μm.

e. Processing of Cylindrical Substrates B-1 to B-4

Cylindrical substrates B-1 to B-4 were produced in the same way as the processing conditions of the cylindrical substrates A-1 to A-4 except for change of a diameter ϕ (outside diameter=60 mm) to a diameter ϕ (outside diameter=45 mm), respectively. The cylindricities of the cylindrical substrates B-1 to B-4 were 7 μm, 23 μm, 34 μm and 44 μm, respectively.

f. Processing of Cylindrical Substrates C-1 to C-4

Cylindrical substrates C-1 to C-4 were produced in the same way as the processing conditions of the cylindrical substrates A-1 to A-4 except for change of a diameter ϕ (outside diameter=60 mm) to a diameter ϕ (outside diameter=30 mm), respectively. The cylindricities of the cylindrical substrates C-1 to C-4 were 6 μm, 21 μm, 34 μm and 42 μm, respectively.

2. Production of Photoreceptor

In the following description, "part" represents weight part.

<<Production of Photoreceptor 1>>

After cleaning the cylindrical substrate A-1, the following dispersion materials were produced and applied to form a photoconductive layer 15 μm in dry thickness.

<Solution of Photoconductive Layer (PCL) Composition> phenol resin: 160 parts photoconductive titanium oxide: 200 parts methyl Cellosolve: 100 parts The following solution of undercoat layer composition was prepared. The coating solution was applied onto the above-described photoconductive layer by a dip coating method to form an undercoat layer 1.0 μm in thickness.

<Solution of Undercoat Layer (UCL) Composition> polyamide resin (amilan CM-8000: produced by Toray Industries Inc.): 60 parts methanol: 1600 parts 1-butanol: 400 parts The following solution of composition was mixed and dispersed by use of a sand mill for 10 hours to prepare coating liquid for a charge generation layer. The coating solution was applied onto the above-described undercoat layer by a dip coating method to form a charge generation layer 0.2 μm in thickness.

<Solution of Charge Generation Layer Composition> titanylphthalocyanine pigment: 60 parts silicone resin solution (KR5240, 15% xylene-butanol solution: produced by Shin-Etsu Chemical Co., LTD.): 700 parts 2-butanone: 2000 parts The following solution of composition was mixed and dissolved to prepare a coating liquid for a charge transport layer. The coating liquid was applied onto the above-described charge generation layer by the circular amount control type coating apparatus described in JP-Tokukaishou-58-189061A to form a charge transport layer 20 μm in thickness, thereby a photoreceptor 1 was produced. The cylindricity of the photoreceptor was 35 μm.

<Solution of Charge Transport Layer (CTL) Composition> charge transport material (N-(4-methylphenyl)-N-{4-(β-phenylstyryl)phenyl}-p-toluidine): 200 parts bisphenol Z polycarbonate (Iupilon Z300: produced by Mitsubishi Gas Chemical Company, Inc.): 300 parts 1,2-dichloroethane: 2000 parts Teflon(R) particles (number average particle size of 0.2 μm): 60 parts <<Production of Photoreceptors 2 to 21>>

As for production of the photoreceptor 1, cylindrical substrate and amounts of Teflon(R) particles and hydrophobic silica particles having a number average particle size of 30 nm were changed as shown in Table 1, and thereby photoreceptors 2 to 21 were produced.

3. Evaluation

The above-described photoreceptors 1 to 21 were evaluated by use of a digital duplicator described in FIG. 5 (including processes adopting corona charging, laser exposure, reverse development, electrostatic transfer and blade cleaning, with A4 printing speed of 20 sheets/min). Cleanability and image were evaluated in such a manner that an original image consisted equally of a text image with an effective pixel rate of 7%, a facial portrait image, a solid white image and a solid white image was duplicated on A4 neutralized paper. The condition of duplication was environment of high temperature and humidity to seems the most difficult, in which one hundred thousand sheets were duplicated successively. Then the halftone, the solid white image and the solid black image were evaluated. Here, before starting the duplication, the surface of a photoreceptor was coated with setting powder. After the photoreceptor and the cleaning blade became familiar with each other, the one hundred thousand sheets were duplicate. Items and criterions for the evaluation will be shown below.

<<Items and Criterions for Evaluation>>

"sharpness (determined by ease to distinguish the text image)"

◎: there is no difference between an initial resolution and that after one hundred thousand sheet duplication o: there is a little degradation of resolution in a halftone image after one hundred thousand sheets duplication X: there is significant degradation of resolution after one hundred thousand sheets duplication "uneven halftone (determined by density difference (ΔHD=maximum density—minimum density) in a halftone image (an uniform image with density near 0.2) after one hundred thousand sheets duplication)"

Densities at 20 points in not-printed copier paper (white paper) were measured by use of Macbeth reflection densitometer "RD-918" in terms of absolute image density, and their average was defined as the white paper density. Then 20 points in the halftone image part were measured in the same way in terms of absolute image density, and their maximum density—their minimum density was evaluated as ΔHD.

◎: not more than 0.05 (good)

o: over 0.05 and under 0.1

X: not less than 0.1

"cleanability (determined by the presence or absence of generation of poor cleaning in solid white area of ten sheets of A3 paper that duplicated successively after duplication of fifty thousand sheets and one hundred thousand sheets)"

◎: there is no generation of slip through of toner and blade riding until one hundred thousand sheets o: there is no generation of slip through of toner and blade riding until fifty thousand sheets X: there is generation of slip through of toner or blade riding under fifty thousand sheets "other evaluation conditions"

Other evaluation conditions of use of the digital duplicator were set to the following conditions.

<Charging Condition> charging unit: scorotron charger, initial charging potential set to −750 V

<Exposure Condition> exposure set as potential of an exposed portion is made −50 V

<Development Condition>

DC bias: −550 V

The developer used above comprises: the carrier in which a core of ferrite was coated with insulation resin; and the toner (volume average particle size of 6.5 μm and toner concentration of 5.5 wt %) in which silica, titanium oxide and the like are externally added to coloring particles comprising styrene acrylic resin as a main material, a coloring agent such as carbon black, a charge control agent and low molecular weight polyolefin.

<Transfer Condition> transfer electrode: corona charging

<Cleaning Condition>

A cleaning blade with hardness of 70° and impact resilience of 65% came into contact with a cleaning part in a counter direction by a spring load method so that its linear pressure is 18 (N/m).

The sizes of the charging unit, the transfer electrode, the cleaning blade and the like were optimized depending on the size of a photoreceptor, and the evaluation was made.

Results of the evaluation were shown in Table 1.

TABLE 1

| Photoreceptor No. | Cylindrical substrate No. | Diameter of cylindrical substrate (mm) | Cylindricity of cylindrical substrate (μm) | Amount of Teflon(R) (part) | Amount of hydrophobic silica (part) | Contact Angle (°) | Variation of contact angle (°) | Sharpness | Uneven halftone | Cleanability |
|---|---|---|---|---|---|---|---|---|---|---|
| 1 | A-1 | 60 | 8 | 60 | 0 | 121 | 3 | ◎ | ◎ | ○ |
| 2 | A-2 | 60 | 25 | 60 | 10 | 118 | 2 | ◎ | ◎ | ◎ |
| 3 | A-2 | 60 | 25 | 30 | 0 | 105 | −4 | ◎ | ◎ | ○ |
| 4 | A-2 | 60 | 25 | 10 | 0 | 92 | 5 | ○ | ○ | ○ |
| 5 | A-2 | 60 | 25 | 5 | 0 | 87 | −3 | ○ | ○ | X |
| 6 | A-3 | 60 | 37 | 60 | 0 | 116 | −4 | ○ | ◎ | ○ |
| 7 | A-4 | 60 | 46 | 60 | 0 | 116 | −6 | ○ | X | ○ |
| 8 | B-1 | 45 | 7 | 60 | 0 | 117 | −3 | ◎ | ◎ | ○ |
| 9 | B-2 | 45 | 23 | 60 | 10 | 119 | 2 | ◎ | ◎ | ◎ |
| 10 | B-2 | 45 | 23 | 30 | 0 | 105 | −4 | ◎ | ◎ | ○ |
| 11 | B-2 | 45 | 23 | 10 | 0 | 92 | 5 | ○ | ○ | ○ |
| 12 | B-2 | 45 | 23 | 5 | 0 | 86 | −4 | ○ | ○ | X |
| 13 | B-3 | 45 | 34 | 60 | 0 | 114 | −5 | ○ | ◎ | ○ |
| 14 | B-4 | 45 | 44 | 60 | 0 | 114 | 7 | X | X | ○ |
| 15 | C-1 | 30 | 6 | 60 | 0 | 116 | 3 | ◎ | ◎ | ○ |
| 16 | C-2 | 30 | 21 | 60 | 10 | 116 | −2 | ◎ | ◎ | ◎ |
| 17 | C-2 | 30 | 21 | 30 | 0 | 104 | 4 | ◎ | ◎ | ○ |
| 18 | C-2 | 30 | 21 | 10 | 0 | 91 | 5 | ○ | ○ | ○ |
| 19 | C-2 | 30 | 21 | 5 | 0 | 86 | 5 | X | ○ | X |
| 20 | C-3 | 30 | 34 | 60 | 0 | 113 | −5 | ○ | ○ | ○ |
| 21 | C-4 | 30 | 42 | 60 | 0 | 113 | −8 | X | X | X |

As Table 1 makes clear, the photoreceptors 1 to 4, 6, 8 to 11, 13, 15 to 18 and 20 satisfying the condition of a contact angle within 90 to 130° on an cylindrical conductive substrate having a cylindricity in the range of 5 to 40 μm, have significant effects of improvement with a focus on cleanability and show as good or better characteristics in uneven halftone and sharpness compared with the photoreceptors 5, 12 and 19 having a contact angle under 90°. They have significant effects with a focus on uneven halftone and are improved in resolution and cleanability as well or better compared with the photoreceptors 7, 14 and 21 having variation of a contact angle over ±5°.

As the above-described examples make clear, the photoreceptors 1 to 4, 6, 8 to 11, 13, 15 to 18 and 20 satisfying the condition of a contact angle within 90 to 130° on an cylindrical conductive substrate having a cylindricity in the range of 5 to 40 μm, were superior in toner cleanability and could form a sharp electrophotographic image without unevenness of image.

That is, the above-described examples were able to provide an electrophotographic photoreceptor, an image forming method, an image forming apparatus and a process cartridge with improved toner transferability and cleanability and capable of providing a high-quality electrophotographic image.

What is claimed is:

1. An electrophotographic photoreceptor comprising a cylindrical conductive substrate having a cylindricity of 5 to 40 μm and a surface layer having a contact angle with water of 90 to 130° on the cylindrical conductive substrate and a variation of the contact angle of the surface layer is ±5° from an average value of the contact angle.

2. The electrophotographic photoreceptor of claim 1, wherein an outside diameter of the cylindrical conductive substrate is from 10 to 60 mm.

3. An image forming apparatus comprising the electrophotographic photoreceptor of claim 1.

4. The image forming apparatus of claim 3, wherein an outside diameter of the cylindrical conductive substrate is from 10 to 60 mm.

5. The image forming apparatus of claim 3, wherein the surface layer contains a surface energy reduction agent.

6. The image forming apparatus of claim 5, wherein the surface energy reduction agent is fluororesin particles containing fluorine atoms.

7. An image forming method comprising forming a latent image on an electrophotographic photoreceptor as defined in claim 1.

8. The image forming method of claim 7 comprising developing the latent image with a developer containing toner having a volume average particle size of 3.5 to 8.5 μm.

9. The image forming method of claim 7, wherein an outside diameter of the cylindrical conductive substrate is from 10 to 60 mm.

10. The image forming method of claim 7, wherein the surface layer contains a surface energy reduction agent.

11. The image forming method of claim 10, wherein the surface energy reduction agent is fluororesin particles containing fluorine atoms.

12. The electrophotographic photoreceptor of claim 1, wherein variation of the contact angle of the surface layer is ±3° from an average value of the contact angle, and the cylindrical conductive substrate has a cylindricity of 7 to 30 μm.

13. The electrophotographic photoreceptor of claim 1, wherein the surface layer comprises a fatty acid metal salt, and the fatty acid metal salt is a metal salt of saturated or unsaturated fatty acid having a carbon number of not less than 10.

14. The electrophotographic photoreceptor of claim 13, wherein the fatty acid metal salt comprises at least one of aluminum stearate, indium stearate, gallium stearate, zinc stearate, lithium stearate, magnesium stearate, sodium stearate, aluminum palmitate and aluminum oleate.

15. The electrophotographic photoreceptor of claim 14, wherein the surface layer further comprises hydrophobic silica particles of a number average particle size of 5 to 1,000 nm.

16. The electrophotographic photoreceptor of claim 1, wherein the surface layer further comprises inorganic particles of a number average particle size of 5 to 1,000 nm.

17. The electrophotographic photoreceptor of claim 16, wherein the inorganic particles include at least one of silica, titanium oxide, alumina, barium titanate calcium titanate, strontium titanate, zinc oxide, magnesium oxide, zirconium oxide, barium sulfate, barium carbonate, calcium carbonate, silicon carbide, silicon nitride, chrome oxide, and red oxide.

18. The electrophotographic photoreceptor of claim 17, wherein the inorganic particles include hydrophobic silica.

19. The electrophotographic photoreceptor of claim 1, wherein she surface layer contains a surface energy reduction agent.

20. The electrophotographic photographic photoreceptor of claim 19, wherein the surface energy reduction agent is fluororesin particles containing fluorine atoms.

* * * * *